US009930467B2

(12) United States Patent
Shi et al.

(10) Patent No.: US 9,930,467 B2
(45) Date of Patent: Mar. 27, 2018

(54) SOUND RECORDING METHOD AND DEVICE

(71) Applicant: Xiaomi Inc., Beijing (CN)

(72) Inventors: Runyu Shi, Beijing (CN); Dawei Xiong, Beijing (CN); Weishan Li, Beijing (CN)

(73) Assignee: Xiaomi Inc., Beijing (CN)

( * ) Notice: Subject to any disclaimer, the term of this patent is extended or adjusted under 35 U.S.C. 154(b) by 62 days.

(21) Appl. No.: 15/058,673

(22) Filed: Mar. 2, 2016

(65) Prior Publication Data

US 2017/0127207 A1 May 4, 2017

(30) Foreign Application Priority Data

Oct. 29, 2015 (CN) ..... 2015 1 0719339

(51) Int. Cl.
*H04R 5/00* (2006.01)
*H04R 3/00* (2006.01)
(Continued)

(52) U.S. Cl.
CPC ..... *H04S 5/005* (2013.01); *H04S 7/307* (2013.01); *H04S 2400/01* (2013.01);
(Continued)

(58) Field of Classification Search
CPC . H04S 5/00; H04S 5/005; H04S 7/301; H04S 7/302; H04S 7/303; H04S 7/307;
(Continued)

(56) References Cited

U.S. PATENT DOCUMENTS 5,796,843 A 8/1998 Inanaga et al.
6,618,485 B1 * 9/2003 Matsuo ..... H04R 3/005 381/111
(Continued)

FOREIGN PATENT DOCUMENTS

CN 1091889 A 9/1994
CN 1275301 A 11/2000
(Continued)

OTHER PUBLICATIONS

International Search Report dated Jul. 22, 2016 for International Application No. PCT/CN2015/098845, 5 pages.
(Continued)

*Primary Examiner* — Xu Mei
(74) *Attorney, Agent, or Firm* — Brinks, Gilson & Lione

(57) ABSTRACT

A sound recording method and device are provided in the field of multimedia processing. The method is applied in a mobile terminal including three microphones, including: acquiring three channels of sound signals collected by the three microphones; calculating a central channel signal, a left channel signal, a right channel signal, a rear left channel signal and a rear right channel signal in a multi-channel surround audio system according to the three channels of sound signals; calculating a bass channel signal in the multi-channel surround audio system according to the three channels of sound signals; and combining the above signals to obtain a sound signal of the multi-channel surround audio system.

18 Claims, 9 Drawing Sheets

(51) Int. Cl.
*H04R 1/40* (2006.01)
*H04S 5/00* (2006.01)
*H04S 7/00* (2006.01)

(52) U.S. Cl.
CPC ..... *H04S 2400/05* (2013.01); *H04S 2400/07* (2013.01); *H04S 2400/09* (2013.01); *H04S 2400/13* (2013.01); *H04S 2400/15* (2013.01)

(58) Field of Classification Search
CPC ..... H04S 2400/00; H04S 2400/05; H04S 2400/07; H04S 2400/09
USPC ..... 381/307, 26, 27, 91, 92, 122, 97, 17–19
See application file for complete search history.

(56) References Cited

U.S. PATENT DOCUMENTS

| | | | | |
|---|---|---|---|---|
| 6,681,018 | B1 | 1/2004 | Asakura et al. | |
| 7,020,290 | B1 * | 3/2006 | Ribic | H04R 3/005 381/122 |
| 7,386,139 | B2 | 6/2008 | Hashimoto et al. | |
| 7,672,467 | B2 | 3/2010 | Okabayashi | |
| 7,760,890 | B2 | 7/2010 | Furge et al. | |
| 8,068,620 | B2 | 11/2011 | Ikeda | |
| 8,081,773 | B2 | 12/2011 | Daishin et al. | |
| 8,320,590 | B2 | 11/2012 | Sungyoung | |
| 8,351,623 | B2 | 1/2013 | Terada | |
| 8,649,529 | B2 * | 2/2014 | Klefenz | G01S 3/809 381/356 |
| 8,654,997 | B2 | 2/2014 | Meehan, Sr. et al. | |
| 9,031,268 | B2 | 5/2015 | Fejzo et al. | |
| 9,055,371 | B2 | 6/2015 | Tammi et al. | |
| 9,253,567 | B2 * | 2/2016 | Morcelli | H04R 3/005 |
| 9,271,076 | B2 * | 2/2016 | Heiman | H04R 3/005 |
| 2003/0076972 | A1 * | 4/2003 | Maejima | H04S 1/002 381/307 |
| 2005/0237395 | A1 | 10/2005 | Takenaka et al. | |
| 2006/0045289 | A1 * | 3/2006 | Kujirai | H04R 1/406 381/92 |
| 2008/0051920 | A1 * | 2/2008 | Hori | H04S 3/02 700/94 |
| 2010/0290643 | A1 | 11/2010 | Mihelich et al. | |
| 2012/0013768 | A1 | 1/2012 | Zurek et al. | |
| 2012/0275619 | A1 | 11/2012 | Daishin et al. | |
| 2013/0343549 | A1 * | 12/2013 | Vemireddy | H04R 5/027 381/17 |
| 2014/0219460 | A1 * | 8/2014 | McGrath | H04S 3/02 381/23 |
| 2015/0125011 | A1 | 5/2015 | Sekiya | |
| 2015/0208168 | A1 | 7/2015 | Tammi et al. | |
| 2016/0066117 | A1 * | 3/2016 | Chen | H04R 3/005 381/26 |

FOREIGN PATENT DOCUMENTS

| | | | |
|---|---|---|---|
| CN | 101138275 | A | 3/2008 |
| CN | 101902679 | A | 12/2010 |
| CN | 102082991 | A | 6/2011 |
| CN | 102438200 | A | 5/2012 |
| CN | 102802112 | A | 11/2012 |
| CN | 103181192 | A | 6/2013 |
| CN | 103905960 | A | 7/2014 |
| CN | 104509131 | A | 4/2015 |
| CN | 104581512 | A | 4/2015 |
| CN | 104837107 | A | 8/2015 |
| EP | 1 933 596 | A1 | 6/2008 |
| EP | 2 079 175 | A2 | 7/2009 |
| EP | 2 530 956 | A1 | 12/2012 |
| EP | 2 530 957 | A2 | 12/2012 |
| JP | H08-509104 | A | 9/1996 |
| JP | 2002-232988 | A | 8/2002 |
| JP | 2002-232989 | A | 8/2002 |
| JP | 2005-311604 | A | 11/2005 |
| JP | 2007-235334 | A | 9/2007 |
| JP | 2014-017645 | A | 1/2014 |
| KR | 10-2013-0116271 | A | 10/2013 |
| WO | WO 1995/020306 | A1 | 7/1995 |
| WO | WO 2007/016527 | A1 | 2/2007 |
| WO | WO 2012/009107 | A1 | 1/2012 |
| WO | WO 2012/061149 | A1 | 5/2012 |
| WO | WO 2013/024200 | A1 | 2/2013 |
| WO | WO 2014/151817 | A1 | 9/2014 |
| WO | WO 2015/076930 | A1 | 5/2015 |

OTHER PUBLICATIONS

English Translation of International Search Report dated Jul. 22, 2016 for International Application No. PCT/CN2015/098845, 4 pages.
Extended European Search Report dated Mar. 22, 2017 for European Application No. 16175978.2, 11 pages.
Office Action dated Dec. 28, 2016 for Chinese Application No. 201510719339.1, 6 pages.
Office Action dated Dec. 20, 2016 for Korean Application No. 10-2016-7004126, 6 pages.
Office Action dated Jun. 27, 2017 for Korean Application No. 10-2016-7004126, 7 pages.
Office Action dated May 31, 2017 for Russian Application No. 2016107764/28, 19 pages.
Decision to Grant dated Sep. 28, 2017 for Russian Application No. 2016107764/28, 18 pages.
Office Action dated Dec. 5, 2017 for Japanese Application No. 2017-547041, 4 pages.

* cited by examiner

SOUND RECORDING METHOD AND DEVICE

CROSS-REFERENCE TO RELATED APPLICATION

This application is based upon and claims priority to Chinese Patent Application 201510719339.1, filed Oct. 29, 2015, the entire contents of which are incorporated herein by reference.

TECHNICAL FIELD

The present disclosure generally relates to field of multimedia processing, and more particularly, to a sound recording method and device.

BACKGROUND

Mobile terminals, such as smart phones, tablet computers or palm computers, are equipped with microphones, and users may record sound via the microphones.

SUMMARY

According to a first aspect of the present disclosure, a sound recording method is implemented in a mobile terminal including at least three microphones. In the method, the mobile terminal acquires three channels of sound signals collected by the three microphones. The mobile terminal calculates a central channel signal, a left channel signal, a right channel signal, a rear left channel signal and a rear right channel signal in a multi-channel surround audio system according to the three channels of sound signals. The mobile terminal calculates a bass channel signal in the multi-channel surround audio system according to the three channels of sound signals. The mobile terminal combines the central channel signal, the left channel signal, the right channel signal, the rear left channel signal, the rear right channel signal, and the bass channel signal to obtain a sound signal of the multi-channel surround audio system.

According to a second aspect of the present disclosure, there is provided a sound recording device including at least three microphones. The mobile terminal includes: a processor; and a memory for storing instructions executable by the processor. The processor is configured to: acquire three channels of sound signals collected by the three microphones; calculate a central channel signal, a left channel signal, a right channel signal, a rear left channel signal and a rear right channel signal in a multi-channel surround audio system according to the three channels of sound signals; calculate a bass channel signal in the multi-channel surround audio system according to the three channels of sound signals; and combine the central channel signal, the left channel signal, the right channel signal, the rear left channel signal, the rear right channel signal, and the bass channel signal to obtain a sound signal of the multi-channel surround audio system.

According to a third aspect of the embodiments of the present disclosure, there is provided a non-transitory computer-readable storage medium including instructions, executable by a processor in a mobile terminal, for performing acts including: acquiring three channels of sound signals collected by the three microphones; calculating a central channel signal, a left channel signal, a right channel signal, a rear left channel signal and a rear right channel signal in a multi-channel surround audio system according to the three channels of sound signals; calculating a bass channel signal in the multi-channel surround audio system according to the three channels of sound signals; and combining the central channel signal, the left channel signal, the right channel signal, the rear left channel signal, the rear right channel signal, and the bass channel signal to obtain a sound signal of the multi-channel surround audio system.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Further-more, the particular features, structures, or characteristics in one or more embodiments may be combined in any suitable manner.

The terminology used in the description of the disclosure herein is for the purpose of describing particular examples only and is not intended to be limiting of the disclosure. As used in the description of the disclosure and the appended claims, the singular forms "a," "an," and "the" are intended to include the plural forms as well, unless the context clearly indicates otherwise. Also, as used in the description herein and throughout the claims that follow, the meaning of "in" includes "in" and "on" unless the context clearly dictates otherwise. It will also be understood that the term "and/or" as used herein refers to and encompasses any and all possible combinations of one or more of the associated listed items. It will be further understood that the terms "may include," "including," "comprises," and/or "comprising," when used in this specification, specify the presence of stated features, operations, elements, and/or components, but do not preclude the presence or addition of one or more other features, operations, elements, components, and/or groups thereof.

Figure 1A:
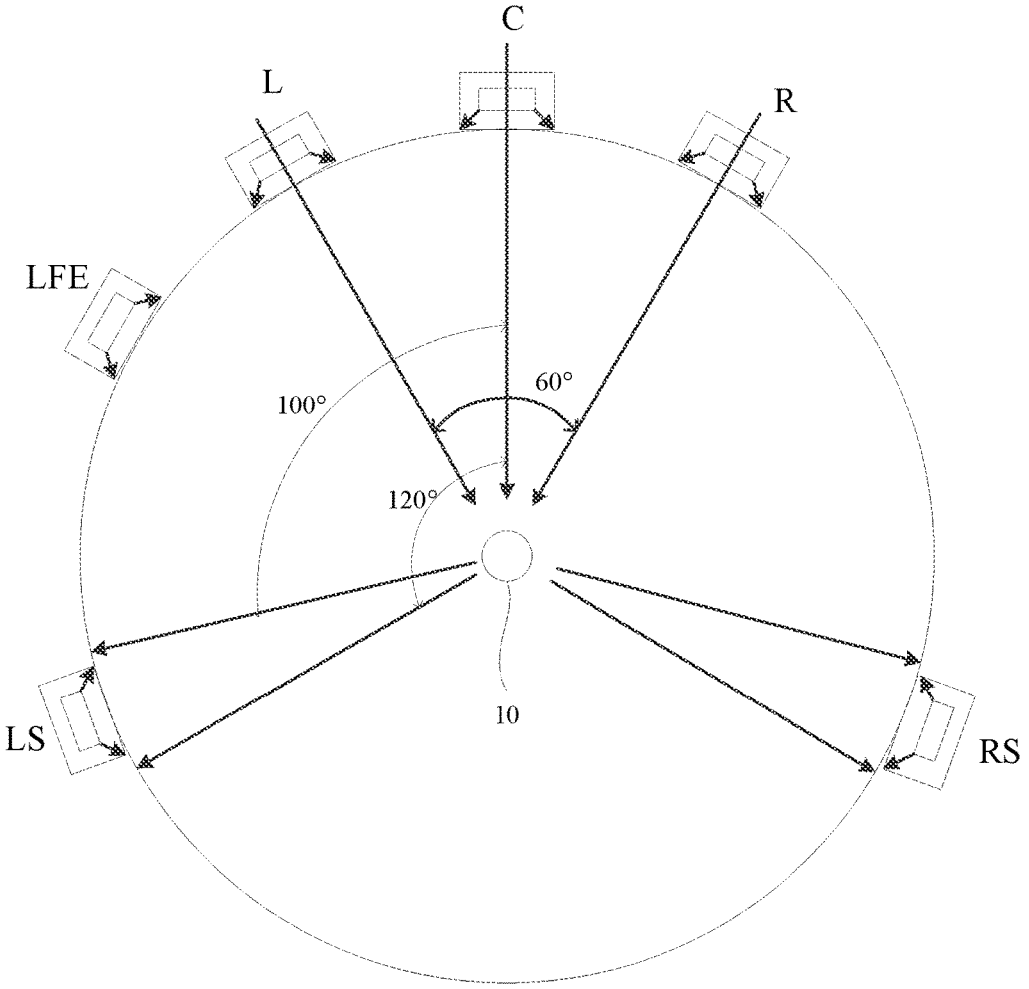
FIG. 1A is a schematic diagram of a sound channel distribution in a multi-channel surround audio system according to one or more embodiments of the present disclosure.

FIG. 1A is a schematic diagram of a sound channel distribution in a multi-channel surround audio system involved by respective embodiments of the present disclosure. The multi-channel surround audio system may be a 5.1 sound channel system, a 6.1 sound channel system, a 7.1 sound channel system, a 5.2 sound channel system, a 7.2 sound channel system, a 10.2 sound channel system, or other surround audio system including multiple sound channels. As shown in FIG. 1A, the multi-channel surround audio system is a 5.1 sound channel system that includes a central sound channel C, a left sound channel L, a right sound channel R, a rear left sound channel LS, a rear right sound channel RS, and a bass sound channel LFE.

Assuming that a user is located at a center point 10 and towards a position of the central sound channel C in FIG. 1A, the distances between any sound channel and the center point at which the user is located may be the same, and the sound channel and the center point at which the user is located are in a same plane.

The center sound channel C is located at a direct front of a facing direction of the user.

The left sound channel L and the right sound channel R are respectively located at two sides of the center sound channel C, respectively have a 30 degree angle with respect to the facing direction of the user, and are disposed symmetrically.

The rear left sound channel LS and the rear right sound channel RS are respectively located at rear of two sides of the facing direction of the user, respectively have a 100-120 degree angle with respect to the facing direction of the user, and are disposed symmetrically.

Because the sense of direction a bass speaker may be relatively weak, there is no strict requirement on a placing position of the bass sound channel LFE. The difference of angle of the bass sound channel LFE with respect to the facing direction of the user results in variation of low pitch in the sound signals of the 5.1 sound channel, and the user may adjust the placing position of the bass sound channel LFE according to needs. The present disclosure does not limit the angle between the bass sound channel LFE and the facing direction of the user, and FIG. 1A only illustratively identifies it.

It should be noted that the angle between each sound channel in the 5.1 sound channel system involved by the embodiments of the present disclosure and the facing direction of the user is illustrative. In addition, the distance between each sound channel and the user may be different, the height of the sound channels may also be different, i.e., the sound channels may not be placed in one plane. The user may adjust the sound channels voluntarily, and difference of placing position of each sound channel may result in difference of the sound signal, which is not limited by the present disclosure.

Figure 1B:
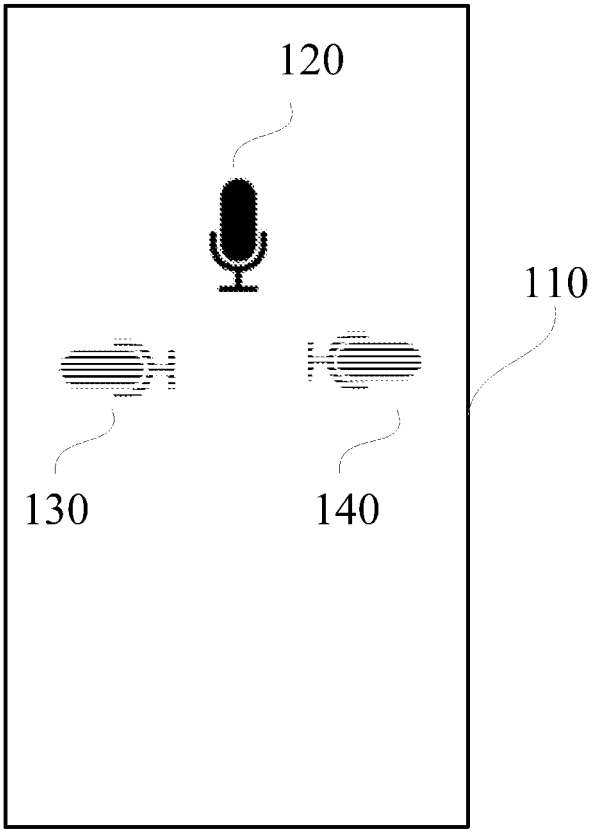
FIG. 1B is a schematic diagram of a terminal according to one or more embodiments of the present disclosure.

FIG. 1B is a schematic diagram of a terminal according to one or more embodiments of the present disclosure. As shown in FIG. 1B, the terminal 110 may include: a first microphone 120, a second microphone 130, and a third microphone 140.

The terminal 110 may be a mobile terminal including three microphones, such as a mobile phone, a media player, a tablet, or a laptop computer.

The terminal 110 may include the first microphone 120, the second microphone 130, and the third microphone 140, which are configured to collect three channels of sound signals. The terminal 110 may include additional microphones.

Alternatively, there are the following two setting manners of the first microphone 120, the second microphone 130, and the third microphone 140.

Figure 1C:
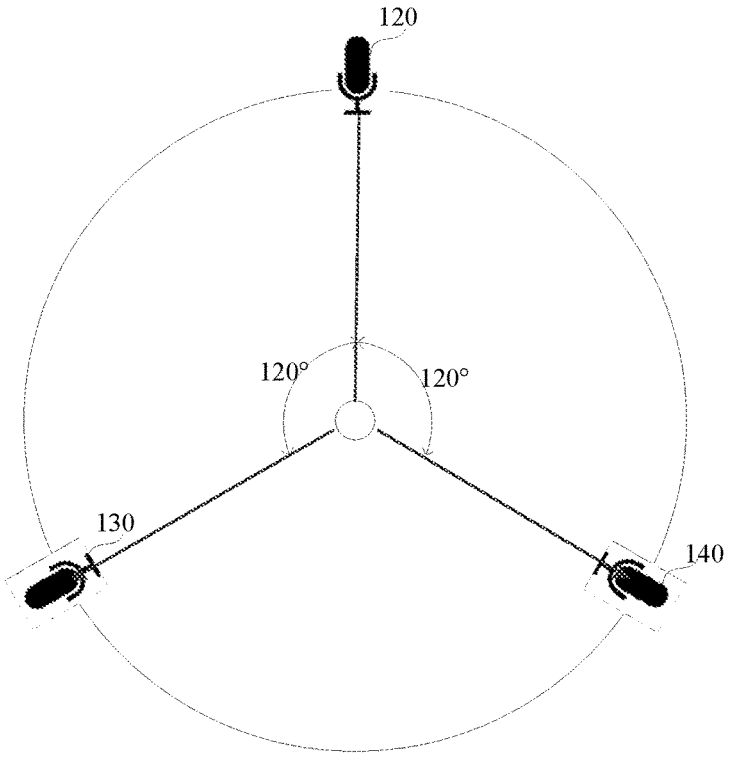
FIG. 1C is a schematic diagram of a terminal according to one or more embodiments of the present disclosure.

One setting manner of the three microphones is shown in FIG. 1C, wherein the first microphone 120 faces forward, the second microphone 130 faces left and has a 100-120 degree angle with the first microphone 120, and the third microphone 140 faces right and has a 100-120 angle with the first microphone 120. That is, the placing position of the first microphone 120 is corresponding to a direction of the central sound channel in the 5.1 sound channel, the placing position of the second microphone 130 is corresponding to a direction of the rear left sound channel, and the placing position of the third microphone 140 is corresponding to a direction of the rear right sound channel.

Figure 1D:
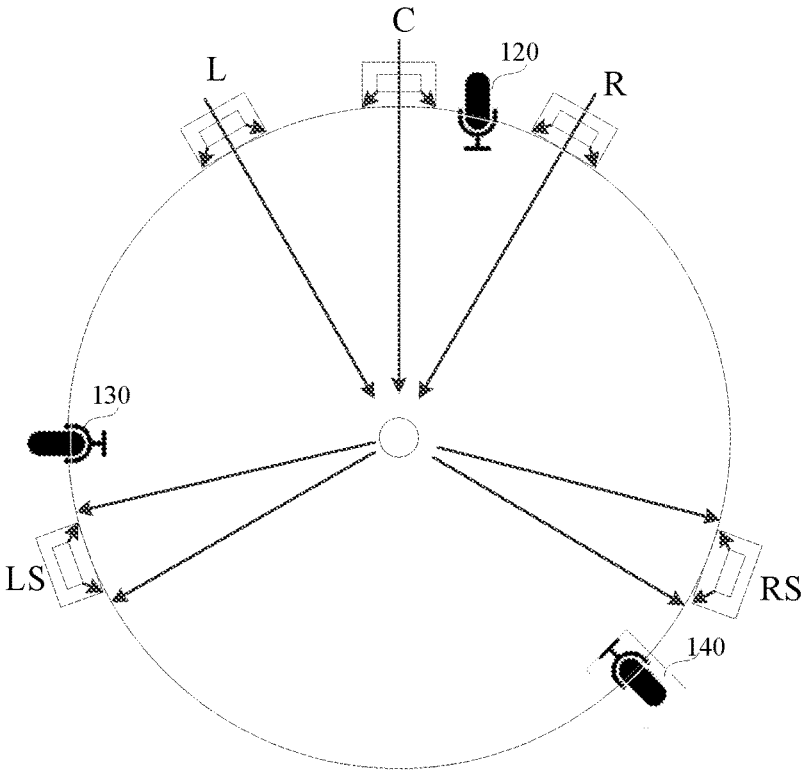
FIG. 1D is a schematic diagram of a terminal according to one or more embodiments of the present disclosure.

The other setting manner of the three microphones is shown in FIG. 1D, wherein the three microphones are freely and dispersedly disposed, and then among the three microphones, there are two microphones nearest to one sound channel in the 5.1 sound channel system. Explanations are given by taking FIG. 1D as an example. The two microphones nearest to the center sound channel C are the first microphone 120 and the second microphone 130; the two microphones nearest to the left sound channel L are the first microphone 120 and the second microphone 130; the two microphones nearest to the right sound channel R are the first microphone 120 and the third microphone 140; the two microphones nearest to the rear left sound channel LS are the first microphone 120 and the third microphone 140; and the two microphones nearest to the rear right sound channel RS are the first microphone 120 and the third microphone 140. Certainly, the three microphones may be located at other positions, as long as they are dispersedly as much as possible, which is not limited by the present disclosure.

Figure 2:
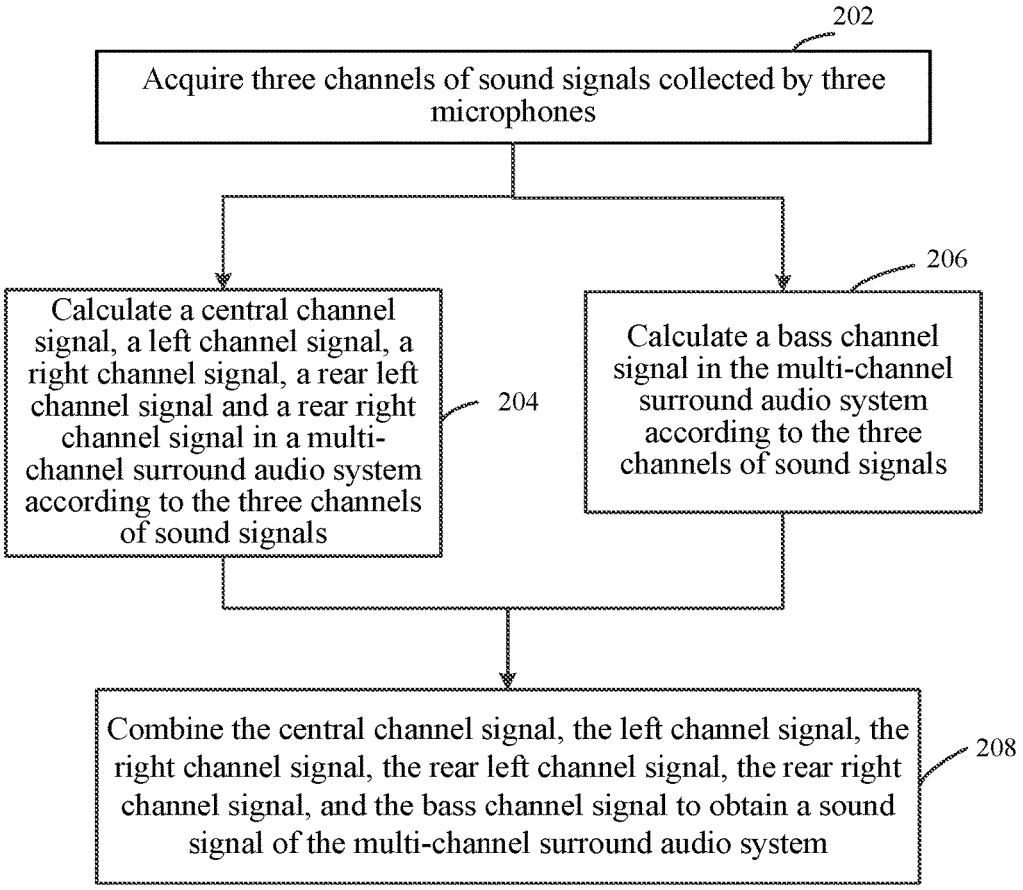
FIG. 2 is a flow chart of a method for recording sound, according to one or more embodiments.

FIG. 2 is a flow chart of a method for recording sound, according to one or more exemplary embodiments. As shown in FIG. 2, the sound recording method is applied in an implementation environment shown in FIG. 1B and FIG. 1C, and involves the 5.1 sound channel system shown in FIG. 1A. The method includes the following steps.

In step 202, three channels of sound signals collected by the three microphones are acquired.

In general, the three sound signals collected by the three microphones are from a same sound source, and distances of the three microphones from the sound source are different. Because the moments at which the sound arrives at respective microphones are different, the three channels of sound signals collected by the three microphones at the same moment may have the same frequency and different amplitudes.

In step 204, a central channel signal, a left channel signal, a right channel signal, a rear left channel signal, and a rear right channel signal in a multi-channel surround audio system are calculated according to the three channels of sound signals.

In step 206, a bass channel signal in the multi-channel surround audio system is calculated according to the three channels of sound signals.

It should be noted, step 204 and step 206 may be parallel, and there is no particular order to implement the two steps.

In step 208, the central channel signal, the left channel signal, the right channel signal, the rear left channel signal, the rear right channel signal, and the bass channel signal are combined to obtain a sound signal of the multi-channel surround audio system.

For example, when the multi-channel surround audio system is a 5.1 sound channel system, three channels of sound signals are collected by three microphones in a terminal, the central channel signal, the left channel signal, the right channel signal, the rear left channel signal, the rear right channel signal, and the bass channel signal are established and calculated according to the three channels of sound signals. The six channel signals are combined into the sound signal of the 5.1 sound channel, which solves the problems in the related art that the audio data recorded by the user can only be single-channel data or dual-channel data and thereby sound field range and sense of immediacy of the recorded audio data are poor, and achieves the effects that the user may record 5.1 sound channel data without changing the hardware configuration of the terminal and thereby recording quality and listening experience of the user are greatly improved.

Since there are two kinds of setting manners of the three microphones in the terminal 110, corresponding to each setting manner, the particular implementing manner of calculating the channel signal in the above step 204 is different.

Figure 3:
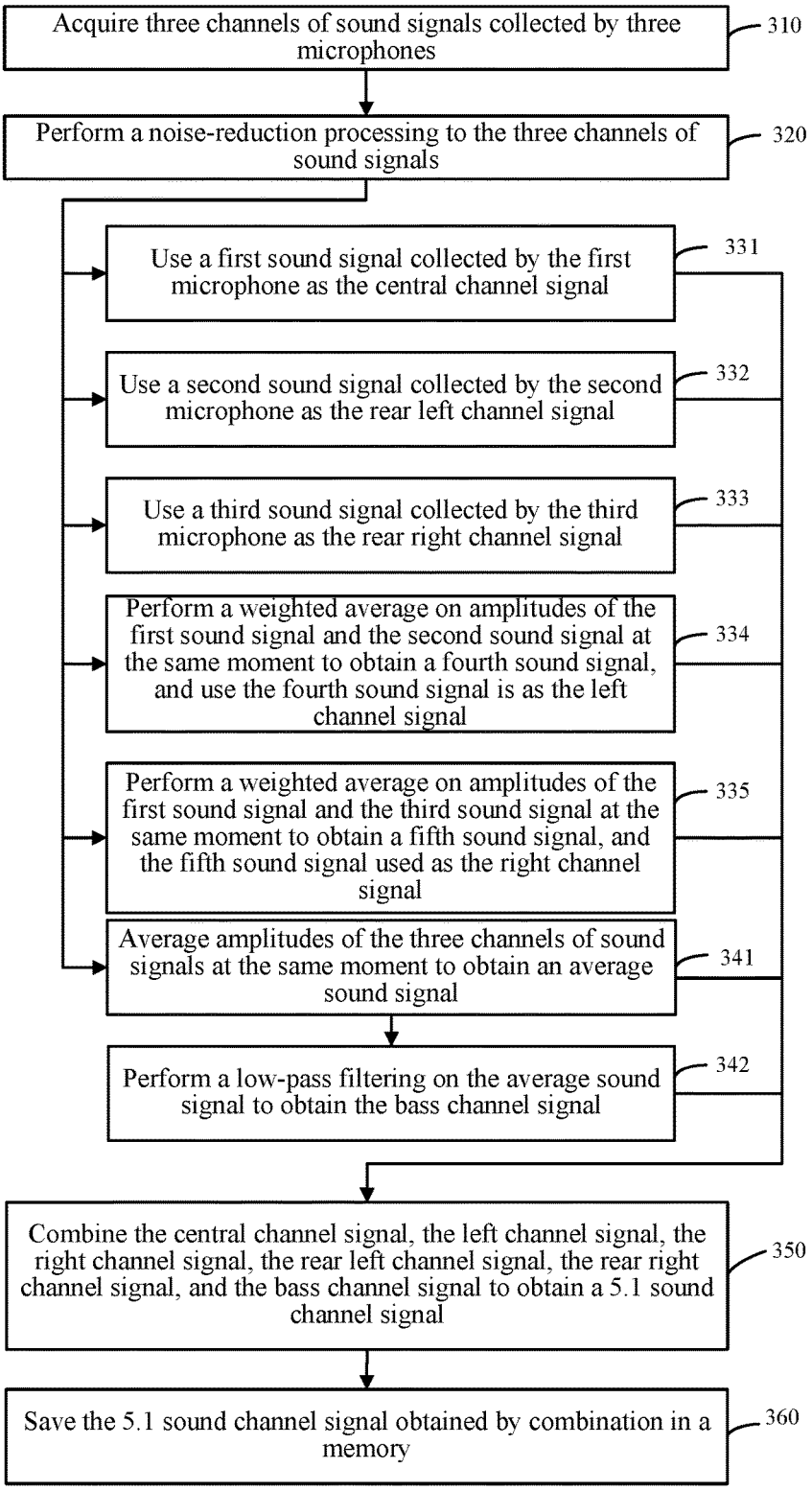
FIG. 3 is a flow chart of a method for recording sound, according to one or more embodiments.

Corresponding to the first setting manner shown in FIG. 1B, i.e., three microphones correspond to the 5.1 sound channel system, the specific implementing manner is shown as the flow chart in FIG. 3, and the above step 204 may be alternatively implemented to include steps 331-335 in FIG. 3.

Figure 4:
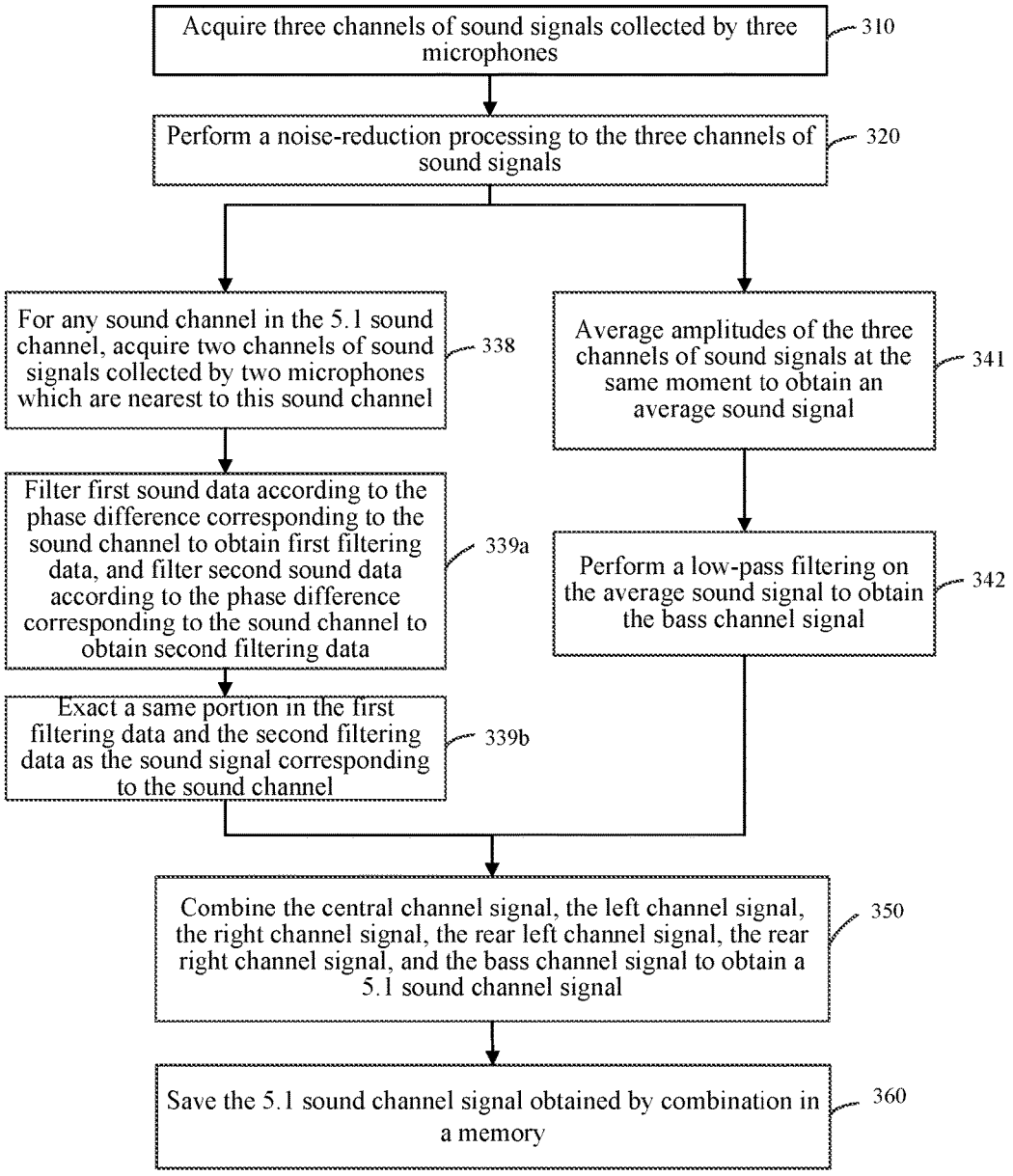
FIG. 4 is a flow chart of a method for recording sound, according to one or more embodiments.

Corresponding to the second setting manner shown in FIG. 1D, i.e., three microphones are freely disposed, the specific implementing manner is shown as the flow chart in FIG. 4, and the above step 204 may be alternatively implemented to include steps 338, 339*a* and 339*b* in FIG. 4.

FIG. 3 is a flow chart of a method for recording sound, according to one or more embodiments. As shown in FIG. 3, illustrations are given by using an example in which the sound recording method is applied in the first setting manner shown in FIG. 1B, and the method includes the following steps.

In step 310, three channels of sound signals collected by the three microphones are acquired. For example, the terminal acquires three channels of sound signals respectively collected by the three microphones. In the present embodiment, the sound signals collected by the first, second and third microphones are respectively denoted by A_mic1, A_mic2 and A_mic3.

The sound signals acquired by the terminal are analog signals. After acquiring the sound signals, the terminal may convert the analog signals into digital signals for subsequent processing, or the collected analog signals may be processed directly, which is not limited by the present embodiment. In the present embodiment, illustrations are given by using an example in which the collected sound signals are converted into digital signals.

In step 320, a noise-reduction processing is performed to the three channels of sound signals. The terminal performs a noise-reduction processing to the acquired three channels of sound signals, and the sound signals of the first, second and third microphones after the noise-reduction are respectively denoted by A_mic1', A_mic2' and A_mic3'.

One noise-reduction method is as follows: removing noise from the signal based on wavelet, performing a multi-layer wavelet signal decomposition to the collected first sound signal A_mic1, selecting a proper threshold to process a high frequency coefficient in each layer of the wavelet signal, and performing a wavelet reconstruction on the processed signals, wherein the outputted signal is A_mic1'. This method may also be adopted for the second and third signals to reduce noise, and the obtained sound signals undergone the noise-reduction are A_mic2' and A_mic3'.

The person skilled in the art may appreciate that the noise-reduction process in this step is not necessary, and is only for improving quality of the sound signal, i.e., this step is optional. In addition, there are many methods for reducing noise, and the noise in the three channels of sound signals may be filtered via various signal processing methods, which is not limited by the present embodiment.

In step 331, a first sound signal collected by the first microphone is used as the central channel signal. The terminal uses A_mic1' obtained by denoising the first sound signal collected by the first microphone as the center channel signal, denoted by A_C', i.e., the central channel signal is A_C', A_C'=A mic1'.

In step 332, a second sound signal collected by the second microphone is used as the rear left channel signal. The terminal uses A_mic2' obtained by denoising the second sound signal collected by the second microphone as the rear left channel signal, denoted by A_LS', i.e., the rear left channel signal is A_LS', A_LS'=A_mic2'.

In step 333, a third sound signal collected by the third microphone is used as the rear right channel signal. The terminal uses A_mic3' obtained by denoising the third sound signal collected by the third microphone as the rear right channel signal, denoted by A_RS', i.e., the rear right channel signal is A_RS', A_RS'=A_mic3'.

In step 334, a weighted average is performed on amplitudes of the first sound signal and the second sound signal at the same moment to obtain a fourth sound signal, and the fourth sound signal is used as the left channel signal.

The terminal performs a weighted average on amplitudes of A_mic1' obtained by denoising the first sound signal and A_mic2' obtained by denoising the second sound signal at the same moment to obtain a fourth sound signal, and uses the fourth sound signal as the left channel signal, denoted by A_L', i.e., the left channel signal is A_L', $$A_L' = a1 * A_\text{mic1}' + b1 * A_\text{mic2}'$$

Here, a1 is a weight of A_mic1', b1 is a weight of A_mic2', specific values of a1 and b1 may be set in advance according to positions of the three microphones and position of each sound channel, or may be set by the user; one possible way of setting values is: a1=0.375, b1=0.625. It should be noted, in the above possible way of setting values, a1+b1=1, and in other possible ways of setting values, a1+b1 may not be 1, the setting manner of a1 and b1, and the specific values of a1 and b1 are not limited by the embodiments of the present disclosure.

In step 335, a weighted average is performed on amplitudes of the first sound signal and the third sound signal at the same moment to obtain a fifth sound signal, and the fifth sound signal is used as the right channel signal.

The terminal performs a weighted average on amplitudes of A_mic1' obtained by denoising the first sound signal and A_mic3' obtained by denoising the third sound signal at the same moment to obtain a fifth sound signal, and uses the fifth sound signal as the right channel signal, denoted by A_R', i.e., the right channel signal is A_R', $$A_R'=a2*A_\text{mic1}'+b2*A_\text{mic3}'$$

Here, a2 is a weight of A_mic1', b2 is a weight of A_mic3', specific values of a2 and b2 may be set in advance according to positions of the three microphones and position of a sound channel, or may be set by the user; one possible way of setting values is: a2=0.375, b2=0.625. It should be noted, in the above possible way of setting values, a2+b2=1, and in other possible ways of setting values, a2+b2 may not be 1, the setting manner of a2 and b2, and the specific values of a2 and b2 are not limited by the embodiments of the present disclosure.

It should be noted, the above steps 331-335 are parallel, and there is no particular order to implement the above steps 331-335.

A bass channel signal in the 5.1 sound channel is calculated according to the three channels of sound signals. Alternatively, the implementing procedure of this step is as follows.

In step 341, amplitudes of the three channels of sound signals at the same moment are averaged to obtain an average sound signal.

The terminal averages amplitudes of A_mic1', A_mic2' and A_mic3' obtained by denoising the three channels of sound signals at the same moment, so as to obtain an average sound signal, denoted by A_LFE, i.e., the average sound signal is A_LFE, $$A_\text{LFE}=(A_\text{mic1}'+A_\text{mic2}'+A_\text{mic3}')/3$$

In step 342, a low-pass filtering is performed on the average sound signal to obtain the bass channel signal.

The terminal performs a low-pass filtering to the average sound signal obtained in the step 341 to obtain the bass channel signal. The cut-off frequency of the low-pass filter is optional, and generally, the cut-off frequency is set to be a value between 80 Hz to 120 Hz, which is not restricted by the present embodiment.

The bass channel signal obtained by the low-pass filtering is denoted by A_LFE', i.e., the bass channel signal is A_LFE', A_LFE'=LPASS(A_LFE), wherein function y=LPASS(x) indicates that y is a signal obtained by making a signal x passing through the low-pass filter.

It should be noted, the step 341 and the steps 331-335 are parallel, and there is no particular order to implement the steps.

In step 350, the central channel signal, the left channel signal, the right channel signal, the rear left channel signal, the rear right channel signal, and the bass channel signal are combined to obtain a sound signal of the 5.1 sound channel.

The terminal combines the central channel signal A_C', the left channel signal A_L', the right channel signal A_R', the rear left channel signal A_LS', the rear right channel signal A_RS', and the bass channel signal A_LFE' obtained by the above steps to obtain the 5.1 sound channel signal, denoted by A_5.1ch. The optional combination manners may be appreciated by the person skilled in the art, which will not be elaborated in the present embodiment.

In step 360, the 5.1 sound channel signal obtained by combination is saved in a memory.

The terminal saves the 5.1 sound channel signal obtained by combination in a memory of the terminal per se, or in an exterior storage device.

When storing the 5.1 sound channel signal, the terminal may adopt formats such as an uncompressed PCM or WAV.

Alternatively, the terminal may also adopt a compression format supporting 5.1 sound channel, such as DolbyDigital, AAC (Advanced Audio Coding), DTS (Digital Theatre System), and 3D-Audio.

In conclusion, in the method provided in the present embodiment, three channels of sound signals are collected by three microphones in a terminal, the central channel signal, the left channel signal, the right channel signal, the rear left channel signal, the rear right channel signal, and the bass channel signal are established and calculated according to the three channels of sound signals, and the six channel signals are combined into the sound signal of the 5.1 sound channel, which solves the problems in the related art that the audio data recorded by the user can only be single-channel data or dual-channel data and thereby sound field range and sense of immediacy of the recorded audio data are poor, and achieves the effects that the user may record 5.1 sound channel data without changing the hardware configuration of the terminal and thereby recording quality and listening experience of the user are greatly improved.

In the sound recording method provided by the present embodiment, the three microphones are placed according to predefined positions, thereby the three sound signals collected by the three microphones can be recorded as 5.1 sound channel data with a relatively small calculated amount, in this way, the following effect is achieved: the user can record 5.1 sound channel data without changing the hardware configuration of the terminal and with a relatively small calculated amount.

FIG. 4 is a flow chart of a method for recording sound, according to one or more embodiments. As shown in FIG. 4, illustrations are given by using an example in which the sound recording method is applied in the second setting manner shown in FIG. 1D, and the method includes the following steps.

In step 310, three channels of sound signals collected by the three microphones are acquired.

The terminal acquires three channels of sound signals respectively collected by the three microphones. In the present embodiment, the sound signals collected by the first, second and third microphones are respectively denoted by A_mic1, A_mic2 and A_mic3.

The sound signals acquired by the terminal are analog signals. After acquiring the sound signals, the terminal may convert the analog signals into digital signals for subsequent processing, or the collected analog signals may be processed directly, which is not limited by the present embodiment. In the present embodiment, illustrations are given by using an example in which the collected sound signals are converted into digital signals.

In step 320, a noise-reduction processing is performed to the three channels of sound signals.

The terminal performs a noise-reduction processing to the acquired three channels of sound signals, and the sound signals of the first, second and third microphones after the noise-reduction are respectively denoted by A_mic1', A_mic2' and A_mic3'.

For example, the terminal may implement a noise-reduction method as follows: removing noise from the signal based on wavelet, performing a multi-layer wavelet signal decomposition to the collected first sound signal A_mic1, selecting a proper threshold to process a high frequency coefficient in each layer of the wavelet signal, and performing a wavelet reconstruction on the processed signals, wherein the outputted signal is A_mic1 This method may also be adopted for the second and third signals to reduce noise, and the obtained sound signals undergone the noise-reduction are A_mic2' and A_mic3'.

The person skilled in the art may appreciate that the noise-reduction process in this step may not be necessary, and is only for improving quality of the sound signal, i.e., this step is optional. In addition, there are many methods for reducing noise, and the noise in the three channels of sound signals may be filtered via various signal processing methods, which is not limited by the present embodiment.

In step 338, for any sound channel in the 5.1 sound channel, two channels of sound signals collected by two microphones which are nearest to this sound channel are acquired.

The terminal acquires position information of the three microphones with respect to an origin point. The origin point mentioned herein indicates a position of a center point 10 of the 5.1 sound channel system, and the terminal establishes a coordinated system based on the origin point.

Alternatively or additionally, one method for establishing the coordinated system is as follows: the center point of the 5.1 sound channel system is used as the origin point, a direction of the center point towards the center sound channel is a positive direction of a y axis, and a direction perpendicular to the y axis and pointing to the right side is a positive direction of x axis. In the present embodiment, illustrations are given by using this coordinated system in combination with FIG. 1A. The present embodiment does not limit the method for establishing the coordinated system.

The terminal denotes positions of the first, second and third microphones in this coordinated system by P_mic1(x1, y1), P_mic2(x2,y2), and P_mic3(x3,y3).

The sound channels in the 5.1 sound channel system have different directions, as shown in FIG. 1A, the direction of the center sound channel is a y axis direction, the direction of the left sound channel leans 30 degree to the left of the positive direction of y axis, the direction of the right sound channel leans 30 degree to the right of the positive direction of y axis, the direction of the rear left sound channel leans 100-120 degree to the left of the positive direction of y axis, and the direction of the rear right sound channel leans 100-120 degree to the right of the positive direction of y axis.

For a sound channel in the 5.1 sound channel, the terminal firstly acquires two channels of sound signals collected by two microphones nearest to the sound channel, then separates out the sound signal corresponding to the sound channel from the two channels of sound signals according to a phase difference of arrival corresponding to the sound channel.

In the present embodiment, the center sound channel is taken as an example for explanation. As shown in FIG. 1D, the two microphones nearest to the center sound channel are the first and second microphones, then two channels of sound signals collected by the two microphones and denoised are respectively A_mic1' and A_mic2'.

Alternatively, the terminal may separate out the sound signal corresponding to the sound channel from the two channels of sound signals according to the phase difference of arrival corresponding to the sound channel, which may include the following two substeps.

In step 339*a*, the first filtering data are obtained by filtering a first channel of sound signal in the two channels of sound signals according to the phase difference of arrival corresponding to the sound channel, and the second filtering data are obtained by filtering a second channel of sound signal in the two channels of sound signals according to the phase difference of arrival corresponding to the sound channel.

Since each microphone may receive sound signals from individual directions, and phase of arrival of the sound signals from respective directions arriving at the three microphones are different, the terminal may exact a sound signal from a certain sound channel according to a phase difference of arrival of each sound channel.

Taking the center sound channel as an example, the two microphones nearest to the center sound channel is the first and second microphones, then the first sound signal is the above first channel of sound signal, and the second sound signal is the above second channel of sound signal. Because the distances between the center sound channel and the nearest first and second microphones are different, a fixed phase difference of arrival exists when the sound in the direction of the center sound channel arrives at the first and second microphones, and the phase difference of arrival is denoted by Δ.

The sound signals of the first channel of sound signal and the second channel of sound signal are divided into a plurality of sub-signals in a same manner, and in general, for each sub-signal in the first channel of sound signal, there is a corresponding sub-signal at the same moment in the second channel of sound signal. Then, the terminal compares a phase difference of arrival between a pair of sub-signals belonging to the same moment in the first channel of sound signal and the second channel of sound signal, and when the phase difference of arrival is A, the signal is deemed as the signal belonging to the direction of the center sound channel, and the signal is maintained; and when the phase difference of arrival is not A, the signal is not deemed as the signal belonging to the direction of the center sound channel, and the signal is filtered. Through such method, the first channel of sound signal is filtered to obtain the first filtering data, and the second channel of sound signal is filtered to obtain the second filtering data.

When dividing the sound signal into a plurality of sub-signals, the terminal may use each audio frame as one sub-signal according to a coding protocol, and the manners of each sub-signal division are not limited by the present embodiment.

In addition, the phase difference of arrival corresponding to a sound channel is calculated by the terminal according to a coordinate position of the microphone in advance.

In step 339*b*, a same portion in the first filtering data and the second filtering data is exacted as the sound signal corresponding to the sound channel.

The terminal exacts the same portion in the first filtering data and the second filtering data as the sound signal corresponding to the sound channel.

The person skilled in the art may appreciate that the sound channel herein may be any one of the central channel signal, the left channel signal, the right channel signal, the rear left channel signal, the rear right channel signal, and the bass channel signal. Each sound channel may be processed by using a processing method similar to the processing method for the center sound channel in the above example. After acquiring the sound signal of one or more sound channels, the terminal denotes the exacted sound signals of these sound channels respectively by the central channel signal A_C', the left channel signal A_L', the right channel signal A_R', the rear left channel signal A_LS', and the rear right channel signal A_RS'.

In step 341, amplitudes of the three channels of sound signals at the same moment are averaged to obtain an average sound signal.

The terminal averages amplitudes of the denoised first sound signal A_mic1', second sound signal A_mic2' and third sound signal A_mic3' at the same moment to obtain an average sound signal, denoted by A_LFE, i.e., the average sound signal is A _LFE, $$A_LFE=(A_mic1'+A_mic2'+A_mic3')/3$$

In step 342, a low-pass filtering is performed to the average sound signal to obtain the bass channel signal.

The terminal performs a low-pass filtering to the average sound signal obtained in the step 341 to obtain the bass channel signal.

The cut-off frequency of the low-pass filter is optional, and generally, the cut-off frequency is set to be a value between 80 Hz to 120 Hz, which is not limited by the present embodiment.

The bass channel signal obtained by the low-pass filtering is denoted by A_LFE', i.e., the bass channel signal is A_LFE', A_LFE'=LPASS(A_LFE), where the function y=LPASS(x) indicates that a signal y is a signal obtained by making a signal x passing through the low-pass filter.

It should be noted, the step 341 and the step 338 are parallel, and there is no specific order to implement the steps.

In step 350, the central channel signal, the left channel signal, the right channel signal, the rear left channel signal, the rear right channel signal, and the bass channel signal are combined to obtain a 5.1 channel signal.

The terminal combines the central channel signal A_C', the left channel signal A_L', the right channel signal A_R', the rear left channel signal A_LS', the rear right channel signal A_RS', and the bass channel signal A_LFE' obtained by the above steps to obtain the 5.1 sound channel signal, denoted by A_5.1ch. The optional combination manners may be appreciated by the person skilled in the art, which will not be elaborated in the present embodiment.

In step 360, the 5.1 sound channel signal obtained by combination is saved in a memory.

The terminal saves the 5.1 sound channel signal obtained by combination in a memory of the terminal per se, or in an exterior storage device.

When storing the 5.1 sound channel signal, the terminal may adopt formats such as an uncompressed PCM or WAV.

Alternatively or additionally, the terminal may also adopt a compression format supporting 5.1 sound channel, such as DolbyDigital, AAC, DTS, and 3D-Audio.

In conclusion, in the method provided in the present embodiment, three channels of sound signals are collected by three microphones in a terminal, the central channel signal, the left channel signal, the right channel signal, the rear left channel signal, the rear right channel signal, and the bass channel signal are established and calculated according to the three channels of sound signals, and the six channel signals are combined into the sound signal of the multi-channel surround audio system, which solves the problems in the related art that the audio data recorded by the user can only be single-channel data or dual-channel data and thereby sound field range and sense of immediacy of the recorded audio data are poor, and achieves the effects that the user may record multi-channel surround audio data and thereby recording quality and listening experience of the user are greatly improved without changing the hardware configuration of the terminal.

In the sound recording method provided by the present embodiment, the three microphones are placed according to predefined positions, thereby the three sound signals collected by the three microphones may be recorded as multi-channel surround audio system data with a relatively small calculated amount. Thus, the user can record multi-channel surround audio system data without changing the hardware configuration of the terminal and with a relatively small calculated amount.

Embodiments of device in the present disclosure are described as follows, and they may be used for performing the method embodiments of the present disclosure. For details not disclosed in the device embodiments of the present disclosure, the method embodiments of the present disclosure may be referred to.

Figure 5:
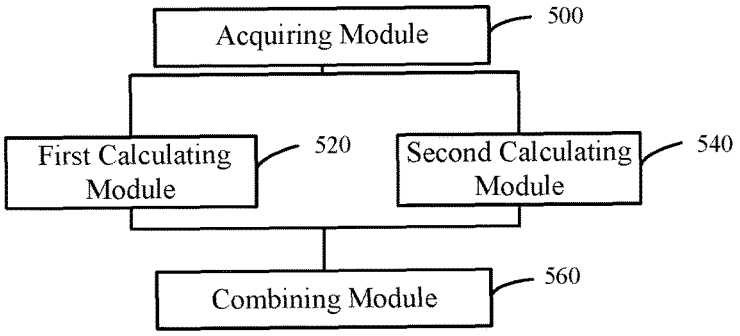
FIG. 5 is a block diagram of a device for recording sound, according to one or more embodiments.

FIG. 5 is a block diagram of a method for recording sound, according to one or more exemplary embodiments. As shown in FIG. 5, the sound recording device is applied in an implementation environment shown in FIG. 1B and involves the 5.1 sound channel system shown in FIG. 1A. The device includes, but is not limited to, an acquiring module 500, a first calculating module 520, a second calculating module 540, and a combining module 560.

The acquiring module 500 is configured to acquire three channels of sound signals collected by the three microphones.

The first calculating module 520 is configured to calculate a central channel signal, a left channel signal, a right channel signal, a rear left channel signal and a rear right channel signal in a 5.1 sound channel according to the three channels of sound signals.

The second calculating module 540 is configured to calculate a bass channel signal in the 5.1 sound channel according to the three channels of sound signals.

The combining module 560 is configured to combine the central channel signal, the left channel signal, the right channel signal, the rear left channel signal, the rear right channel signal, and the bass channel signal to obtain a sound signal of the 5.1 sound channel.

In conclusion, in the sound recording device provided in the embodiment of the present disclosure, three channels of sound signals are collected by three microphones in a terminal, the central channel signal, the left channel signal, the right channel signal, the rear left channel signal, the rear right channel signal, and the bass channel signal are established and calculated according to the three channels of sound signals. The multiple channel signals are combined into the sound signal of the multi-channel surround audio system, which solves the problems in the related art that the audio data recorded by the user can only be single-channel data or dual-channel data and thereby sound field range and sense of immediacy of the recorded audio data are poor, and achieves the effects that the user may record multi-channel surround audio system data and thereby recording quality and listening experience of the user are greatly improved without changing the hardware configuration of the terminal.

Figure 6:
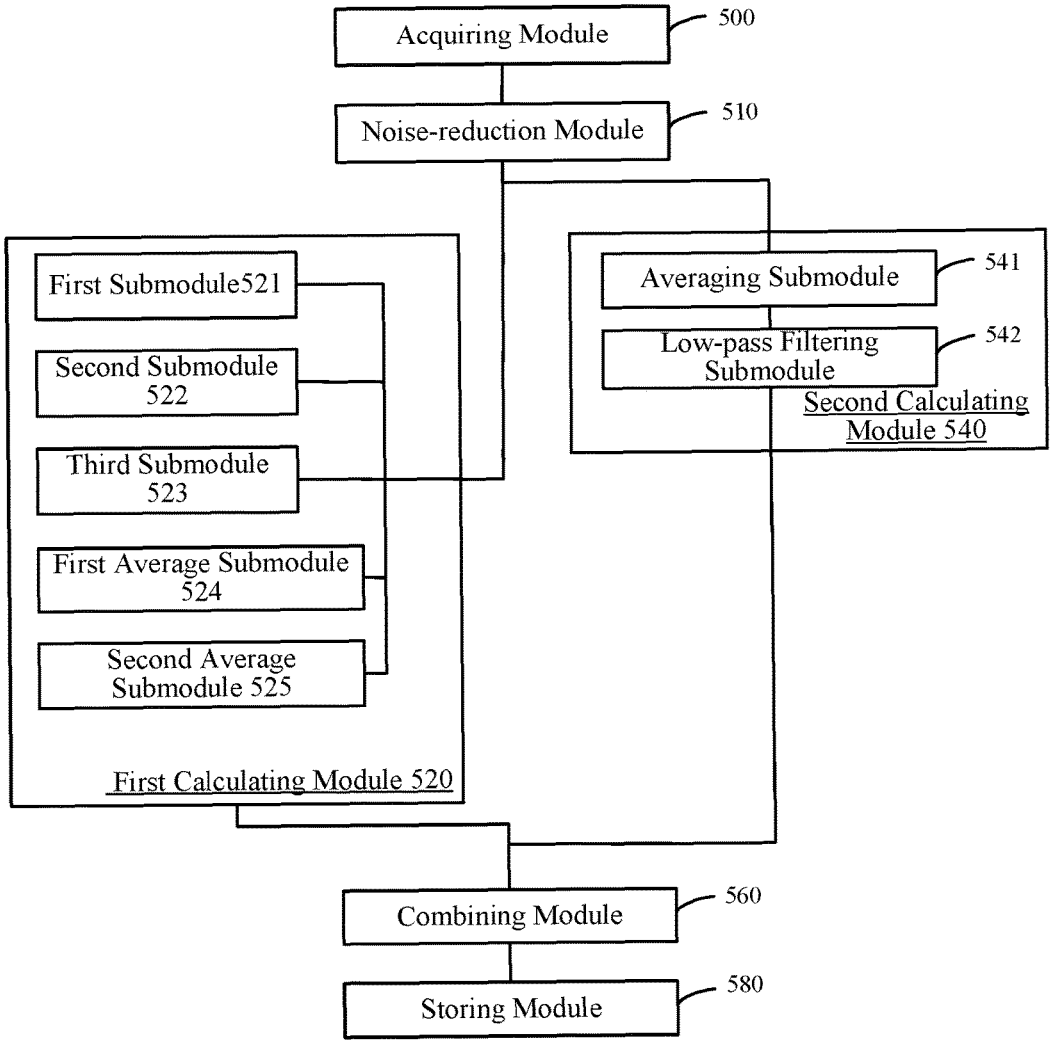
FIG. 6 is a block diagram of a device for recording sound, according to one or more embodiments.

FIG. 6 is a block diagram of a method for recording sound, according to one or more embodiments. As shown in FIG. 6, illustrations are given by using an example in which the sound recording device is applied in the first setting manner shown in FIG. 1B, and the device includes, but is not limited to, an acquiring module 500, a noise-reduction module 510, a first calculating module 520, a second calculating module 540, a combining module 560, and a storing module 580.

The acquiring module 500 is configured to acquire three channels of sound signals collected by the three microphones.

The noise-reduction module 510 is configured to perform a noise-reduction processing to the three channels of sound signals.

The first calculating module 520 is configured to calculate a central channel signal, a left channel signal, a right channel signal, a rear left channel signal and a rear right channel signal in a 5.1 sound channel according to the three channels of sound signals.

In particular, the first calculating module 520 includes a first submodule 521, a second submodule 522, a third submodule 523, a first average submodule 524, and a second average submodule 525.

The first submodule 521 is configured to use a first sound signal collected by the first microphone as the central channel signal.

The second submodule 522 is configured to use a second sound signal collected by the second microphone as the rear left channel signal.

The third submodule 523 is configured to use a third sound signal collected by the third microphone as the rear right channel signal.

The first average submodule 524 is configured to perform a weighted average to amplitudes of the first sound signal and the second sound signal at the same moment to obtain a fourth sound signal and use the fourth sound signal as the left channel signal.

The second average submodule 525 is configured to perform a weighted average on amplitudes of the first sound signal and the third sound signal at the same moment to obtain a fifth sound signal and use the fifth sound signal as the right channel signal.

The second calculating module 540 is configured to calculate a bass channel signal in the multi-channel surround audio system according to the three channels of sound signals. The second calculating module 540 includes: an averaging submodule 541, and a low-pass filtering submodule 542.

The averaging submodule 541 is configured to average amplitudes of the three channels of sound signals at the same moment to obtain an average sound signal.

The low-pass filtering submodule 542 is configured to perform a low-pass filtering to the average sound signal to obtain the bass channel signal.

The combining module 560 is configured to combine the central channel signal, the left channel signal, the right channel signal, the rear left channel signal, the rear right channel signal, and the bass channel signal to obtain a sound signal of the 5.1 sound channel.

The storing module 580 is configured to save the 5.1 sound channel signal obtained by combination into a memory.

With respect to the devices in the above embodiments, the specific manners for performing operations for individual modules therein have been described in detail in the embodiments regarding the methods, which will not be elaborated herein.

One exemplary embodiment of the present disclosure provides a sound recording device for a mobile terminal provided with three microphones and being capable of realizing the sound recording method provided by the present disclosure. The device includes: a processor; and a memory for storing instructions executable by the processor;

wherein the processor is configured to:

acquire three channels of sound signals collected by the three microphones;

calculate a central channel signal, a left channel signal, a right channel signal, a rear left channel signal and a rear right channel signal in a 5.1 sound channel according to the three channels of sound signals;

calculate a bass channel signal in the 5.1 sound channel according to the three channels of sound signals; and combine the central channel signal, the left channel signal, the right channel signal, the rear left channel signal, the rear right channel signal, and the bass channel signal to obtain a sound signal of the 5.1 sound channel.

Alternatively, when the above three microphones includes a first microphone located in a central channel direction of the 5.1 sound channel, a second microphone located in a rear left channel direction of the 5.1 sound channel, and a third microphone located in a rear right channel direction of the 5.1 sound channel, the processor is configured to:

use a first sound signal collected by the first microphone as the central channel signal;

use a second sound signal collected by the second microphone as the rear left channel signal;

use a third sound signal collected by the third microphone as the rear right channel signal;

perform a weighted average on amplitudes of the first sound signal and the second sound signal at the same moment to obtain a fourth sound signal and use the fourth sound signal as the left channel signal; and perform a weighted average on amplitudes of the first sound signal and the third sound signal at the same moment to obtain a fifth sound signal and use the fifth sound signal as the right channel signal.

Alternatively, when the three microphones are dispersedly disposed with respect to an origin point, the processor is configured to:

for any sound channel in the 5.1 sound channel, acquire two channels of sound signals collected by the two nearest microphones; and separate out a sound signal corresponding to the sound channel from the two channels of sound signals according to a phase difference of arrival corresponding to the sound channel, filter a first channel of sound signal in the two channels of sound signals according to the phase difference of arrival corresponding to the sound channel to obtain first filtering data, filter a second channel of sound signal in the two channels of sound signals according to the phase difference of arrival corresponding to the sound channel to obtain second filtering data; and exact a same portion in the first filtering data and the second filtering data as the sound signal corresponding to the sound channel, wherein the phase difference of arrival is a difference between initial phrase angles of sound from the sound channel when arriving at the two microphones respectively, and the sound signal corresponding to the sound channel is any one of the central channel signal, the left channel signal, the right channel signal, the rear left channel signal and the rear right channel signal.

Alternatively, the processor is configured to:

average amplitudes of the three channels of sound signals at the same moment to obtain an average sound signal; and perform a low-pass filtering on the average sound signal to obtain the bass channel signal.

Alternatively, the processor is configured to:

perform a noise-reduction processing on the three channels of sound signals.

Figure 7:
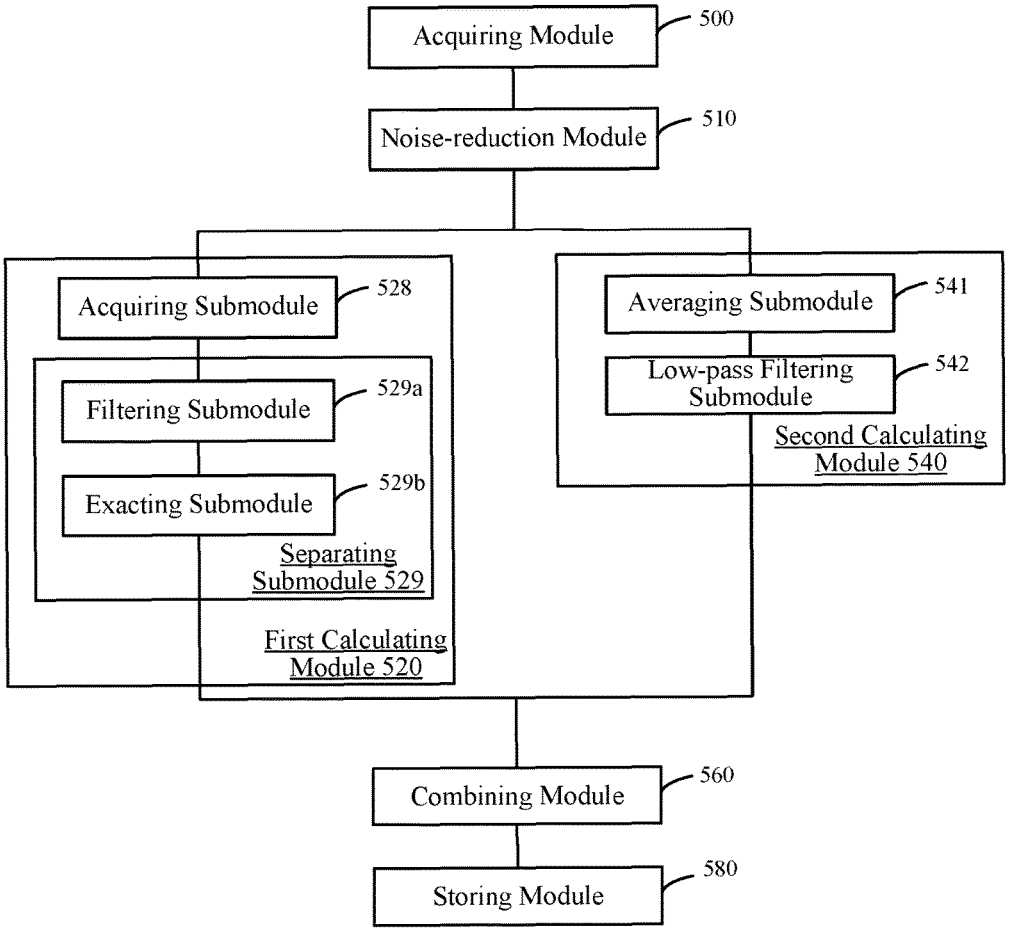
FIG. 7 is a block diagram of a device for recording sound, according to one or more embodiments.

FIG. 7 is a block diagram of a method for recording sound, according to one or more embodiments. As shown in FIG. 7, illustrations are given by using an example in which the sound recording device is applied in the second setting manner shown in FIG. 1D, and the device includes, but is not limited to, an acquiring module 500, a noise-reduction module 510, a first calculating module 520, a second calculating module 540, a combining module 560, and a storing module 580.

The acquiring module 500 is configured to acquire three channels of sound signals collected by the three microphones.

The noise-reduction module 510 is configured to perform a noise-reduction processing to the three channels of sound signals.

The first calculating module 520 is configured to calculate a central channel signal, a left channel signal, a right channel signal, a rear left channel signal and a rear right channel signal in a 5.1 sound channel according to the three channels of sound signals.

In particular, the first calculating module 520 includes: an acquiring submodule 528, and a separating submodule 529.

The acquiring submodule 528 is configured to, for any sound channel in the 5.1 sound channel, acquire two channels of sound signals collected by the two nearest microphones.

The separating submodule 529 is configured to separate out a sound signal corresponding to the sound channel from the two channels of sound signals according to a phase difference of arrival corresponding to the sound channel.

Further, the above separating submodule 529 submodule includes: a first separating submodule 529*a* and a filtering submodule 529*b*.

The first separating submodule 529*a* is configured to filter first sound data according to the phase difference of arrival corresponding to the sound channel to obtain first filtering data; and filter second sound data according to the phase difference of arrival corresponding to the sound channel to obtain second filtering data.

The exacting submodule 529*b* is configured to exact a same portion in the first filtering data and the second filtering data as the sound signal corresponding to the sound channel.

The second calculating module 540 is configured to calculate a bass channel signal in the 5.1 sound channel according to the three channels of sound signals. The second calculating module 540 includes: an averaging submodule 541 and a low-pass filtering submodule 542.

The averaging submodule 541 is configured to average amplitudes of the three channels of sound signals at the same moment to obtain an average sound signal.

The low-pass filtering submodule 542 is configured to perform a low-pass filtering on the average sound signal to obtain the bass channel signal.

The combining module 560 is configured to combine the central channel signal, the left channel signal, the right channel signal, the rear left channel signal, the rear right channel signal, and the bass channel signal to obtain a sound signal of the 5.1 sound channel.

The storing module 580 is configured to save the 5.1 sound channel signal obtained by combination into a memory.

Figure 8:
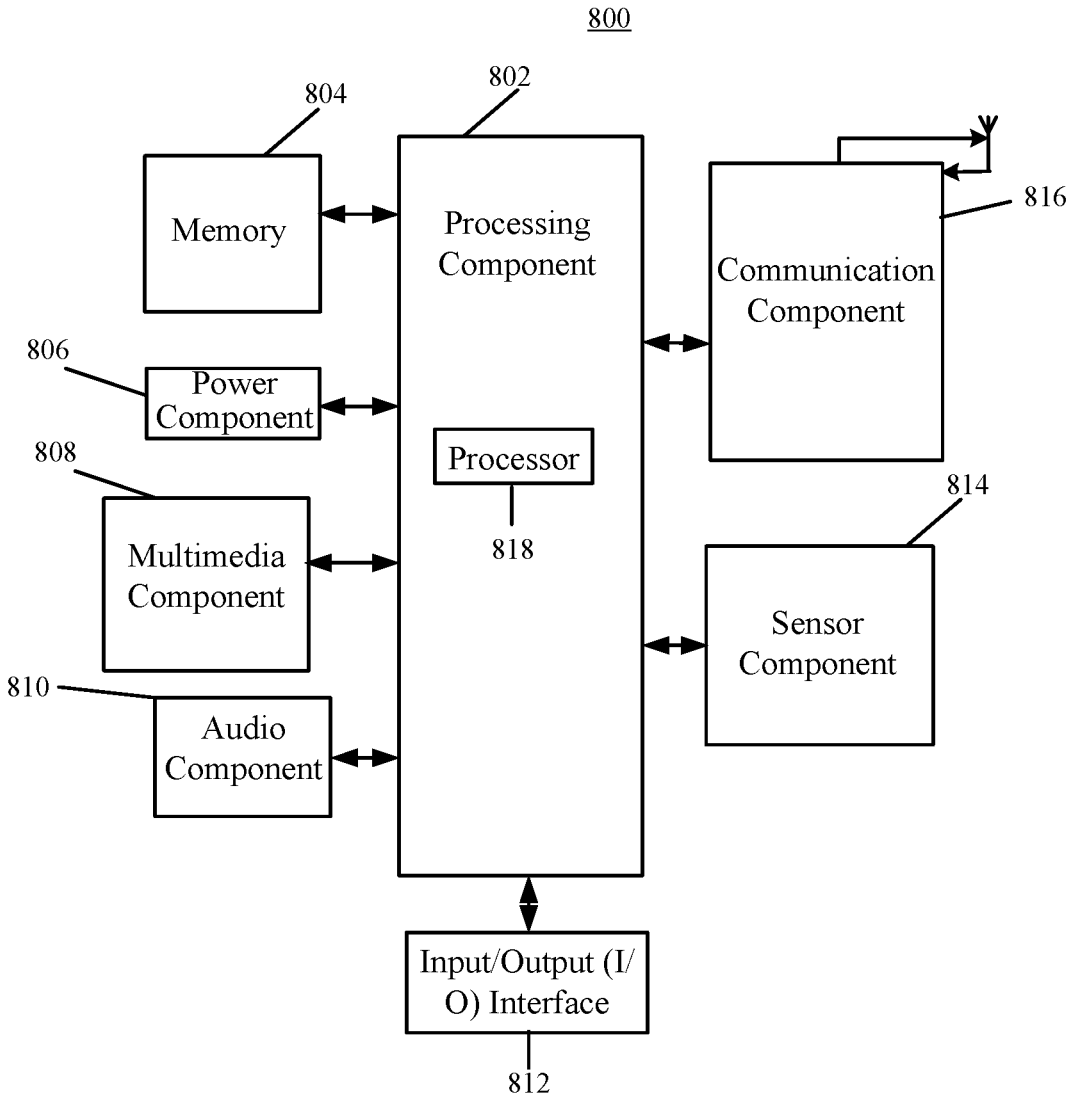
FIG. 8 is a block diagram of a device, according to one or more exemplary embodiments.

FIG. 8 is a block diagram of a device, according to one or more exemplary embodiments. For example, the device 800 may be a mobile phone, a computer, a digital broadcast terminal, a messaging device, a gaming console, a tablet, a medical device, exercise equipment, a personal digital assistant, and the like.

Referring to FIG. 8, the device 800 may include one or more of the following components: a processing component 802, a memory 804, a power component 806, a multimedia component 808, an audio component 810, an input/output (I/O) interface 812, a sensor component 814, and a communication component 816.

The processing component 802 typically controls overall operations of the device 800, such as the operations associated with display, telephone calls, data communications, camera operations, and recording operations. The processing component 802 may include one or more processors 818 to execute instructions to perform all or part of the steps in the above described methods. Moreover, the processing component 802 may include one or more modules which facilitate the interaction between the processing component 802 and other components. For instance, the processing component 802 may include a multimedia module to facilitate the interaction between the multimedia component 808 and the processing component 802.

The memory 804 is configured to store various types of data to support the operation of the device 800. Examples of such data include instructions for any applications or methods operated on the device 800, contact data, phonebook data, messages, pictures, video, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 806 provides power to various components of the device 800. The power component 806 may include a power management system, one or more power sources, and any other components associated with the generation, management, and distribution of power in the device 800.

The multimedia component 808 includes a screen providing an output interface between the device 800 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 808 includes a front camera and/or a rear camera. The front camera and the rear camera may receive an external multimedia datum while the device 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone ("MIC") configured to receive an external audio signal when the device 800 is in an operation mode, such as a call mode, a recording mode, and a voice recognition mode. The received audio signal may be further stored in the memory 804 or transmitted via the communication component 816. In some embodiments, the audio component 810 further includes a speaker to output audio signals.

The I/O interface 812 provides an interface between the processing component 802 and peripheral interface modules, such as a keyboard, a click wheel, buttons, and the like. The buttons may include, but are not limited to, a home button, a volume button, a starting button, and a locking button.

The sensor component 814 includes one or more sensors to provide status assessments of various aspects of the device 800. For instance, the sensor component 814 may detect an open/closed status of the device 800, relative positioning of components, e.g., the display and the keypad, of the device 800, a change in position of the device 800 or a component of the device 800, a presence or absence of user contact with the device 800, an orientation or an acceleration/deceleration of the device 800, and a change in temperature of the device 800. The sensor component 814 may include a proximity sensor configured to detect the presence of nearby objects without any physical contact. The sensor component 814 may also include a light sensor, such as a CMOS or CCD image sensor, for use in imaging applications. In some embodiments, the sensor component 814 may also include an accelerometer sensor, a gyroscope sensor, a magnetic sensor, a pressure sensor, or a temperature sensor.

The communication component 816 is configured to facilitate communication, wired or wirelessly, between the device 800 and other devices. The device 800 can access a wireless network based on a communication standard, such as WiFi, 2G or 3G or a combination thereof. In one exemplary embodiment, the communication component 816 receives a broadcast signal or broadcast associated information from an external broadcast management system via a broadcast channel. In one exemplary embodiment, the communication component 816 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 800 may be implemented with one or more processing circuitry including application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods. Each module or submodule discussed above, such as the acquiring module 500, the first calculating module 520, the second calculating module 540, and the combining module 560, may take the form of a packaged functional hardware unit designed for use with other components, a portion of a program code (e.g., software or firmware) executable by the processor 818 or the processing circuitry that usually performs a particular function of related functions, or a self-contained hardware or software component that interfaces with a larger system, for example.

In exemplary embodiments, there is also provided a non-transitory computer-readable storage medium including instructions, such as included in the memory 804, executable by the processor 818 in the device 800, for performing the above-described sound recording methods. For example, the non-transitory computer-readable storage medium may be a ROM, a RAM, a CD-ROM, a magnetic tape, a floppy disc, an optical data storage device, and the like.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A sound recording method, comprising:

acquiring, by a mobile terminal comprising three microphones, three channels of sound signals collected by the three microphones, wherein the three microphones comprise a first microphone representative of a central channel direction of a multi-channel surround audio system, a second microphone representative of a rear left channel direction of the multi-channel surround audio system, and a third microphone representative of a rear right channel direction of the multi-channel surround audio system;

calculating, by the mobile terminal, a central channel signal, a left channel signal, a right channel signal, a rear left channel signal, and a rear right channel signal in the multi-channel surround audio system according to the three channels of sound signals, by:

using a first sound signal collected by the first microphone as the central channel signal;

using a second sound signal collected by the second microphone as the rear left channel signal;

using a third sound signal collected by the third microphone as the rear right channel signal;

performing a first weighted average on amplitudes of the first sound signal and the second sound signal at the same moment to obtain a fourth sound signal and using the fourth sound signal as the left channel signal; and performing a second weighted average on amplitudes of the first sound signal and the third sound signal at the same moment to obtain a fifth sound signal and using the fifth sound signal as the right channel signal;

calculating, by the mobile terminal, a bass channel signal in the multi-channel surround audio system according to the three channels of sound signals; and combining, by the mobile terminal, the central channel signal, the left channel signal, the right channel signal, the rear left channel signal, the rear right channel signal, and the bass channel signal to obtain a sound signal of the multi-channel surround audio system.

2. The method of claim 1, wherein the calculating the bass channel signal in the multi-channel surround audio system according to the three channels of sound signals comprises:

averaging amplitudes of the three channels of sound signals at the same moment to obtain an average sound signal; and performing a low-pass filtering on the average sound signal to obtain the bass channel signal.

3. The method of claim 1, further comprising:

performing a noise-reduction processing to the three channels of sound signals.

4. A mobile terminal, comprising:

three microphones;

a processor; and a memory for storing instructions executable by the processor;

wherein the processor is configured to:

acquire three channels of sound signals collected by the three microphones, wherein the three microphones comprise a first microphone representative of a central channel direction of a multi-channel surround audio system, a second microphone representative of a rear left channel direction of the multi-channel surround audio system, and a third microphone representative of a rear right channel direction of the multi-channel surround audio system;

calculate a central channel signal, a left channel signal, a right channel signal, a rear left channel signal, and a rear right channel signal in a multi-channel surround audio system according to the three channels of sound signals, by:

using a first sound signal collected by the first microphone as the central channel signal;

using a second sound signal collected by the second microphone as the rear left channel signal;

using a third sound signal collected by the third microphone as the rear right channel signal;

performing a first weighted average on amplitudes of the first sound signal and the second sound signal at the same moment to obtain a fourth sound signal and using the fourth sound signal as the left channel signal; and performing a second weighted average on amplitudes of the first sound signal and the third sound signal at the same moment to obtain a fifth sound signal and using the fifth sound signal as the right channel signal;

calculate a bass channel signal in the multi-channel surround audio system according to the three channels of sound signals; and combine the central channel signal, the left channel signal, the right channel signal, the rear left channel signal, the rear right channel signal, and the bass channel signal to obtain a sound signal of the multi-channel surround audio system.

5. The mobile terminal claim 4, wherein the processor is further configured to:

average amplitudes of the three channels of sound signals at the same moment to obtain an average sound signal; and perform a low-pass filtering on the average sound signal to obtain the bass channel signal.

6. The mobile terminal of claim 4, wherein the processor is further configured to:

perform a noise-reduction processing to the three channels of sound signals.

7. A non-transitory readable storage medium comprising instructions which, when executed by a mobile terminal comprising a processor and three microphones, cause the mobile terminal to perform acts comprising:

acquiring three channels of sound signals collected by the three microphones, wherein the three microphones comprise a first microphone representative of a central channel direction of a multi-channel surround audio system, a second microphone representative of a rear left channel direction of the multi-channel surround audio system, and a third microphone representative of a rear right channel direction of the multi-channel surround audio system;

calculating a central channel signal, a left channel signal, a right channel signal, a rear left channel signal, and a rear right channel signal in the multi-channel surround audio system according to the three channels of sound signals, by:

using a first sound signal collected by the first microphone as the central channel signal;

using a second sound signal collected by the second microphone as the rear left channel signal;

using a third sound signal collected by the third microphone as the rear right channel signal;

performing a first weighted average on amplitudes of the first sound signal and the second sound signal at the same moment to obtain a fourth sound signal and using the fourth sound signal as the left channel signal; and performing a second weighted average on amplitudes of the first sound signal and the third sound signal at the same moment to obtain a fifth sound signal and using the fifth sound signal as the right channel signal;;

calculating a bass channel signal in the multi-channel surround audio system according to the three channels of sound signals; and combining the central channel signal, the left channel signal, the right channel signal, the rear left channel signal, the rear right channel signal, and the bass channel signal to obtain a sound signal of the multi-channel surround audio system.

8. The non-transitory readable storage medium of claim 7, wherein the calculating the bass channel signal in the multi-channel surround audio system according to the three channels of sound signals comprises:

averaging amplitudes of the three channels of sound signals at the same moment to obtain an average sound signal; and performing a low-pass filtering on the average sound signal to obtain the bass channel signal.

9. The non-transitory readable storage medium of claim 7, wherein the instructions, when executed by the mobile terminal, further cause the mobile terminal to perform an act of performing a noise-reduction processing to the three channels of sound signals.

10. A sound recording method, comprising:

acquiring, by a mobile terminal comprising three microphones, three channels of sound signals collected by the three microphones, wherein the three microphones are dispersedly disposed with respect to an origin point;

calculating, by the mobile terminal, a central channel signal, a left channel signal, a right channel signal, a rear left channel signal, and a rear right channel signal in a multi-channel surround audio system according to the three channels of sound signals, by:

for a sound channel in the multi-channel surround audio system, acquiring two channels of sound signals collected by two microphones nearest to the sound channel, and separating out a sound signal corresponding to the sound channel from the two channels of sound signals according to a phase difference of arrival corresponding to the sound channel, wherein the phase difference of arrival is a difference between initial phase angles of sound from the sound channel when arriving at the two microphones respectively;

calculating, by the mobile terminal, a bass channel signal in the multi-channel surround audio system according to the three channels of sound signals; and combining, by the mobile terminal, the central channel signal, the left channel signal, the right channel signal, the rear left channel signal, the rear right channel signal, and the bass channel signal to obtain a sound signal of the multi-channel surround audio system.

11. The method of claim 10, wherein the separating out the sound signal corresponding to the sound channel from the two channels of sound signals according to the phase difference of arrival corresponding to the sound channel comprises:

filtering a first channel of sound signal in the two channels of sound signals according to the phase difference of arrival corresponding to the sound channel to obtain first filtering data, filtering a second channel of sound signal in the two channels of sound signals according to the phase difference of arrival corresponding to the sound channel to obtain second filtering data; and exacting a same portion in the first filtering data and the second filtering data as the sound signal corresponding to the sound channel.

12. The method of claim 10, further comprising:

performing a noise-reduction processing to the three channels of sound signals.

13. A mobile terminal, comprising:

three microphones;

a processor; and a memory for storing instructions executable by the processor;

wherein the processor is configured to:

acquire three channels of sound signals collected by the three microphones, wherein the three microphones are dispersedly disposed with respect to an origin point;

calculate a central channel signal, a left channel signal, a right channel signal, a rear left channel signal, and a rear right channel signal in a multi-channel surround audio system according to the three channels of sound signals, by:

for a sound channel in the multi-channel surround audio system, acquiring two channels of sound signals collected by two microphones nearest to the sound channel, and separating out a sound signal corresponding to the sound channel from the two channels of sound signals according to a phase difference of arrival corresponding to the sound channel, wherein the phase difference of arrival is a difference between initial phase angles of sound from the sound channel when arriving at the two microphones respectively;

calculate a bass channel signal in the multi-channel surround audio system according to the three channels of sound signals; and combine the central channel signal, the left channel signal, the right channel signal, the rear left channel signal, the rear right channel signal, and the bass channel signal to obtain a sound signal of the multi-channel surround audio system.

14. The mobile terminal of claim 13, wherein the processor is further configured to:

filter a first channel of sound signal in the two channels of sound signals according to the phase difference of arrival corresponding to the sound channel to obtain first filtering data, and filter a second channel of sound signal in the two channels of sound signals according to the phase difference of arrival corresponding to the sound channel to obtain second filtering data; and exact a same portion in the first filtering data and the second filtering data as the sound signal corresponding to the sound channel.

15. The mobile terminal of claim 13, wherein the processor is further configured to:

perform a noise-reduction processing to the three channels of sound signals.

16. A non-transitory readable storage medium comprising instructions which, when executed by a mobile terminal comprising a processor and three microphones, cause the mobile terminal to perform acts comprising:

acquiring three channels of sound signals collected by the three microphones, wherein the three microphones are dispersedly disposed with respect to an origin point;

calculating a central channel signal, a left channel signal, a right channel signal, a rear left channel signal, and a rear right channel signal in a multi-channel surround audio system according to the three channels of sound signals, by:

for a sound channel in the multi-channel surround audio system, acquiring two channels of sound signals collected by two microphones nearest to the sound channel, and separating out a sound signal corresponding to the sound channel from the two channels of sound signals according to a phase difference of arrival corresponding to the sound channel, wherein the phase difference of arrival is a difference between initial phase angles of sound from the sound channel when arriving at the two microphones respectively;

calculating a bass channel signal in the multi-channel surround audio system according to the three channels of sound signals; and combining the central channel signal, the left channel signal, the right channel signal, the rear left channel signal, the rear right channel signal, and the bass channel signal to obtain a sound signal of the multi-channel surround audio system.

17. The non-transitory readable storage medium of claim 16, wherein the instructions, when executed by the mobile terminal, further cause the mobile terminal to perform acts of:

filtering a first channel of sound signal in the two channels of sound signals according to the phase difference of arrival corresponding to the sound channel to obtain first filtering data, and filtering a second channel of sound signal in the two channels of sound signals according to the phase difference of arrival corresponding to the sound channel to obtain second filtering data; and exacting a same portion in the first filtering data and the second filtering data as the sound signal corresponding to the sound channel.

18. The non-transitory readable storage medium of claim 16, wherein the instructions, when executed by the mobile terminal, further cause the mobile terminal to perform an act of performing a noise-reduction processing to the three channels of sound signals.

* * * * *